US008845462B2

(12) United States Patent
Chung

(10) Patent No.: US 8,845,462 B2
(45) Date of Patent: Sep. 30, 2014

(54) BALL BAT

(76) Inventor: Min-Ju Chung, Taichung (TW)

( * ) Notice: Subject to any disclaimer, the term of this patent is extended or adjusted under 35 U.S.C. 154(b) by 209 days.

(21) Appl. No.: 13/613,529

(22) Filed: Sep. 13, 2012

(65) Prior Publication Data

US 2013/0252770 A1 Sep. 26, 2013

(30) Foreign Application Priority Data

Mar. 26, 2012 (TW) ..... 101205419 U

(51) Int. Cl.
*A63B 69/00* (2006.01)
*A63B 59/00* (2006.01)

(52) U.S. Cl.
USPC ..... 473/457; 422/564; 422/422

(58) Field of Classification Search
CPC ..... A63B 69/0002; A63B 69/0008; A63B 59/00; A63B 59/0014; A63B 59/0088
USPC ..... 473/457, 564, 568
See application file for complete search history.

(56) References Cited

U.S. PATENT DOCUMENTS 3,554,545 A * 1/1971 Mann et al. ..... 473/564
4,682,773 A 7/1987 Pomilia
5,088,733 A * 2/1992 Barnea et al. ..... 473/568
6,004,234 A * 12/1999 Majchrowicz ..... 473/560
6,352,485 B1 * 3/2002 Philpot et al. ..... 473/564
6,500,079 B1 * 12/2002 Tucker, Sr. ..... 473/513
6,609,984 B1 * 8/2003 Tribble ..... 473/564
7,014,580 B2 * 3/2006 Forsythe et al. ..... 473/566
7,198,581 B1 * 4/2007 Black ..... 473/454
7,744,497 B2 * 6/2010 Phelan, Jr. ..... 473/457
8,052,547 B2 * 11/2011 Nusbaum et al. ..... 473/457
8,066,594 B2 * 11/2011 Leinert ..... 473/568
8,083,620 B2 * 12/2011 Sims et al. ..... 473/568

FOREIGN PATENT DOCUMENTS

JP 3161190 U 6/2010

OTHER PUBLICATIONS

Chinese Patent Office, Chinese Office Action issued in corresponding application No. CN201210103412.9 dated Dec. 3, 2013.

* cited by examiner

*Primary Examiner* — Mitra Aryanpour
(74) *Attorney, Agent, or Firm* — Trop Pruner & Hu, P.C.

(57) ABSTRACT

A ball bat includes a barrel section extending along an axis, a throat section extending taperingly from the barrel section along the axis, an upper handle section extending along the axis and connected to the throat section, and a lower handle section abutting against an end of the upper handle section. The ball bat further includes a connecting unit including a connecting rod that extends from the upper handle section and a retaining space that is formed in the lower handle section for being engaged fittingly and separably with the connecting rod, and a securing unit having a securing member for securing separably the lower handle section to the connecting rod of the connecting unit.

11 Claims, 7 Drawing Sheets

BALL BAT

CROSS-REFERENCE TO RELATED APPLICATION

This application claims priority of Taiwanese Application No. 101205419, filed on Mar. 26, 2012.

BACKGROUND OF THE INVENTION

1. Field of the Invention

The invention relates to a ball bat, more particularly to a ball bat in which an orientation of a barrel section is adjustable relative to a lower handle section.

2. Description of the Related Art

Referring to FIGS. 1 and 2, an asymmetric baseball bat 1 disclosed in U.S. Pat. No. 7,878,930 has a barrel portion 11, a throat portion 12, and a handle portion 13 that has a non-circular cross-section with a center deviated from a longitudinal axis 10 of the baseball bat 1.

Compared with a conventional symmetric baseball bat, the asymmetric baseball bat 1 may be grasped and swung more comfortably since it allows a batter to have a more secure grip on the handle portion 13. In addition, such configuration assists the batter in maintaining a particular orientation of the baseball bat 1 relative to the batter's hands. However, such configuration also results in a specific and unchanged ball-striking region 15 on the barrel portion 11 of the baseball bat 1. Therefore, the asymmetric baseball bat 1 has a relatively short service life.

U.S. Pat. No. 6,752,731 discloses a grip that is sized to fit around a handle portion of a baseball bat, so that the baseball bat equipped with the grip may function as an asymmetric baseball bat. Although a baseball bat sleeved by the grip is not limited to strike a ball on a specific region of a barrel portion thereof, the add-on grip also increases undesirably the size of the original handle portion of the baseball bat and hence affects adversely the secure grasp of a batter thereof.

SUMMARY OF THE INVENTION

Therefore, the object of the present invention is to provide a ball bat in which an orientation of a barrel section is adjustable relative to a lower handle section.

Accordingly, a ball bat of the present invention comprises:

a barrel section extending along an axis;

a throat section extending taperingly from an end of the barrel section along the axis;

an upper handle section extending along the axis from an end of the throat section opposite to the barrel section, and having a first annular end opposite to the throat section;

a lower handle section extending along the axis, and having a second annular end that abuts against the first annular end and that has a contour identical to that of the first annular end, and a bottom end portion that is opposite to the second annular end;

a connecting unit including a connecting rod that extends from the first annular end of the upper handle section along the axis, and a retaining space that is formed in the lower handle section, that extends inwardly from the second annular end of the lower handle section along the axis, and that is engaged fittingly and separably with the connecting rod; and a securing unit having a through hole that is formed in the lower handle section, that is in spatial communication with the retaining space, and that extends along the axis, an abutment surface that is disposed at an end of the through hole opposite to the retaining space, and a securing member that has a rod portion extending through the through hole and secured to the connecting rod of the connecting unit, and a head portion connected to the rod portion and abutting against the abutment surface.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
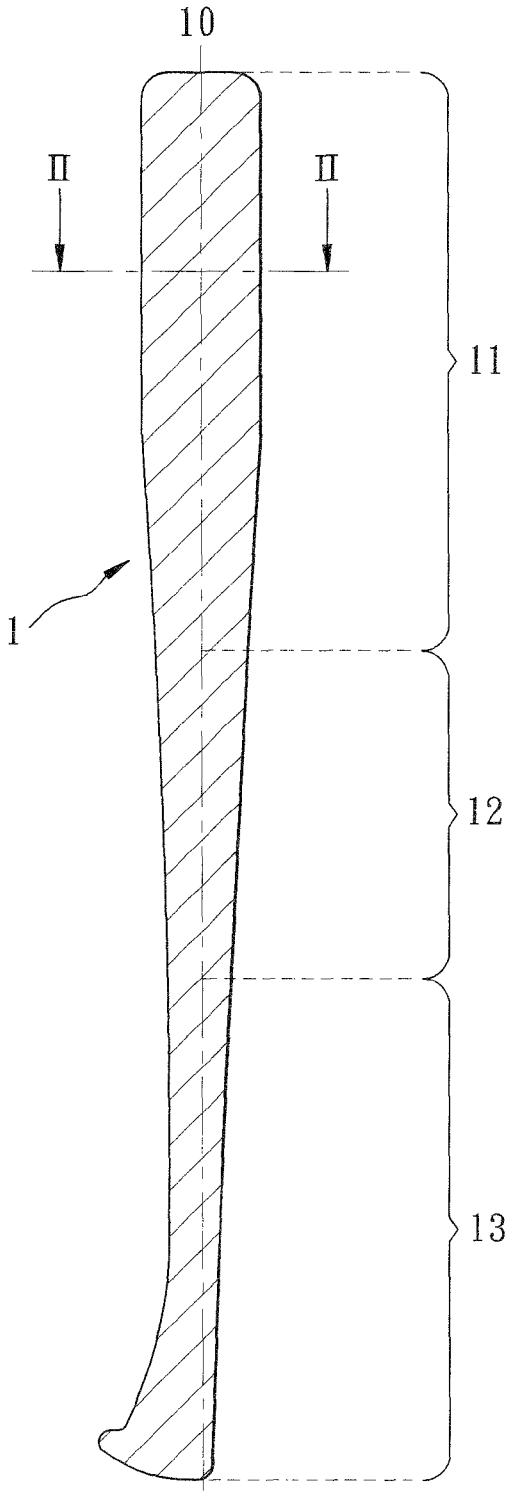
FIG. 1 PRIOR ART
FIG. 1 (prior art) is a sectional view of an asymmetric baseball bat disclosed in U.S. Pat. No. 7,878,930.
Figure 2:
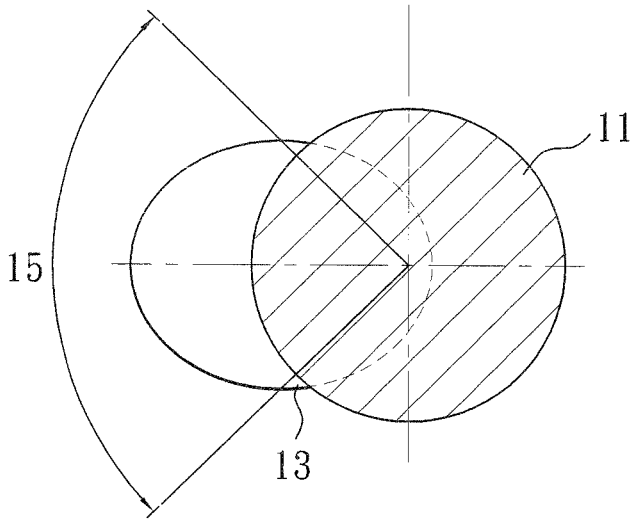
FIG. 2 PRIOR ART
FIG. 2 (prior art) is a sectional view of the asymmetric baseball bat taken along line II-II in FIG. 1.
Figure 3:
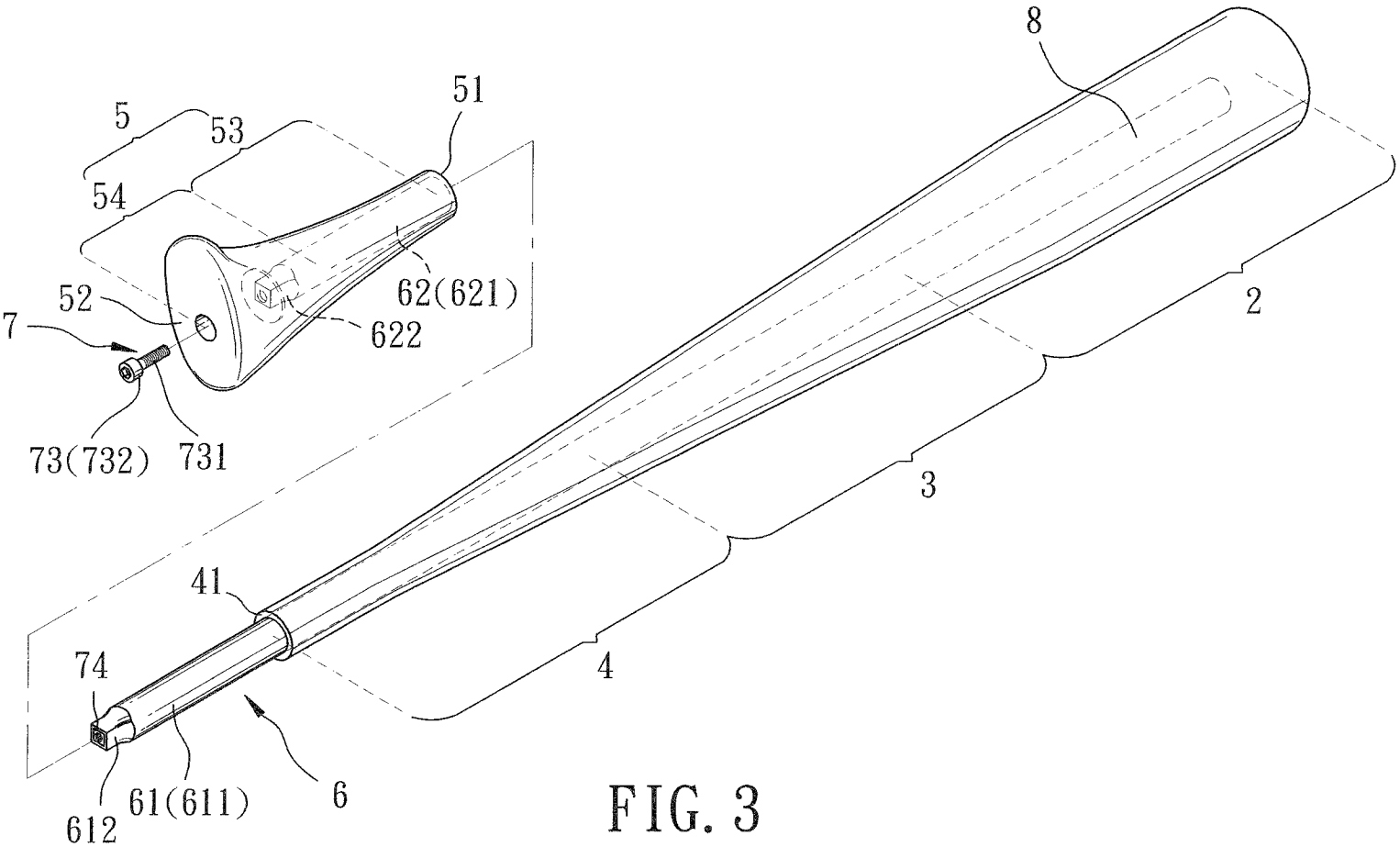
FIG. 3 is an exploded perspective view of a preferred embodiment of a ball bat according to the invention.
Figure 4:
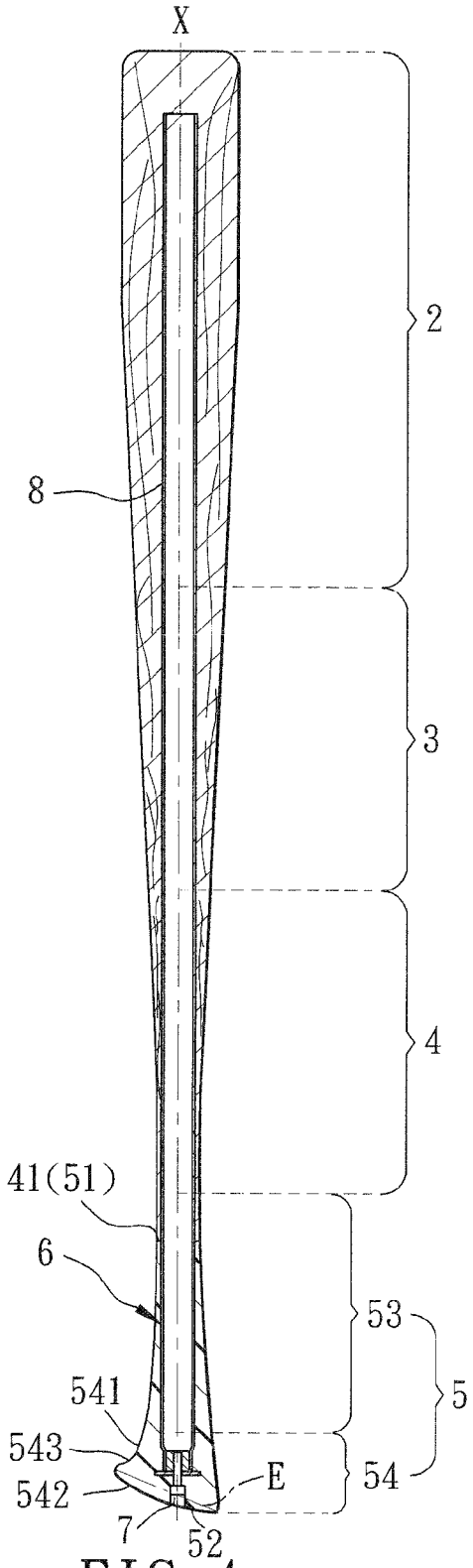
FIG. 4 is a sectional view of the preferred embodiment.
Figure 5:
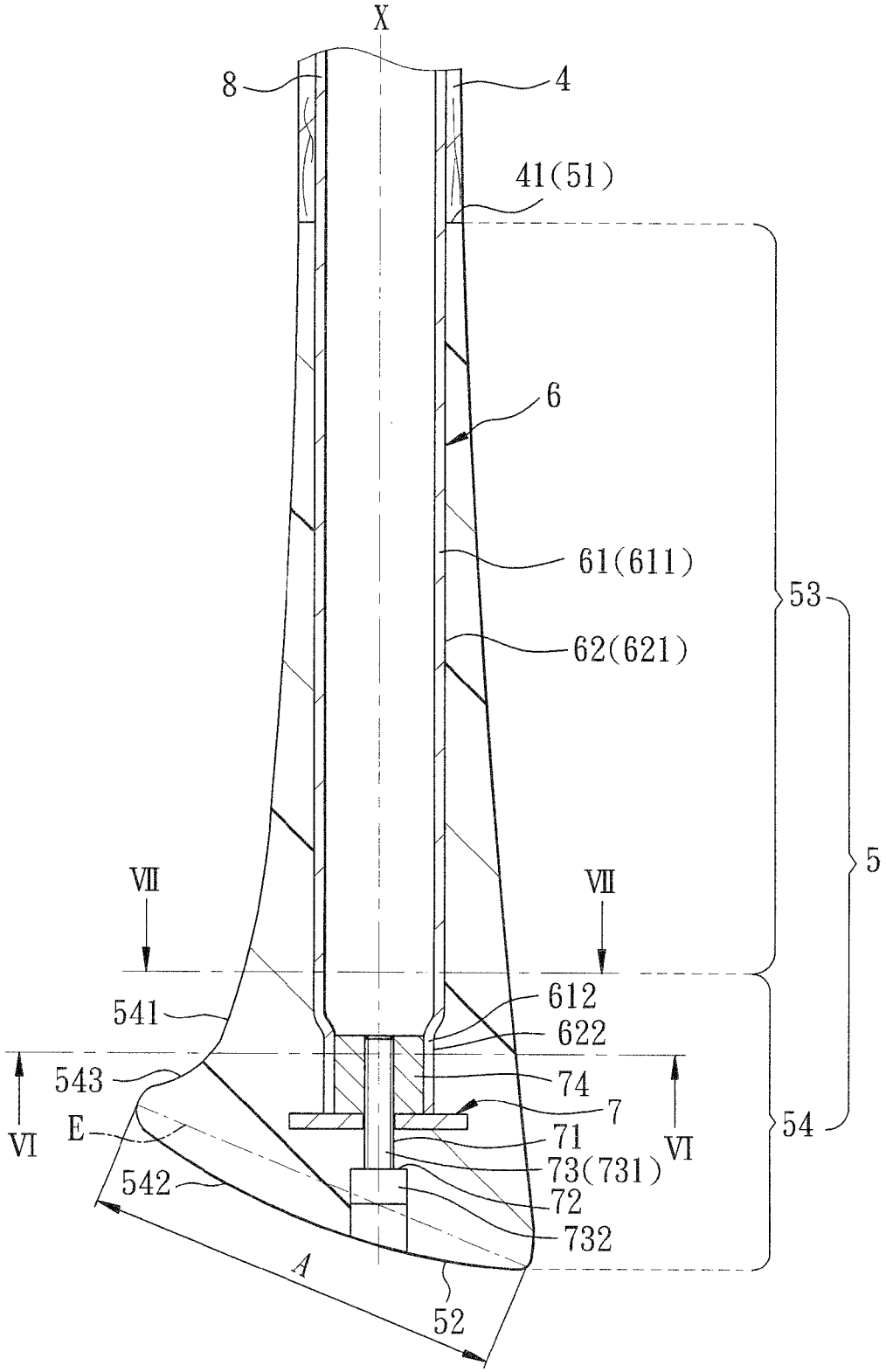
FIG. 5 is an enlarged fragmentary sectional view of the preferred embodiment.

As shown in FIGS. 3, 4 and 5, a preferred embodiment of a ball bat according to the present invention comprises a barrel section 2, a throat section 3, an upper handle section 4, a lower handle section 5, a connecting unit 6, a securing unit 7, and a reinforcing tube 8.

The barrel section 2 extends along an axis (X). The throat section 3 extends taperingly from an end of the barrel section 2 along the axis (X). The upper handle section 4 extends along the axis (X) from an end of the throat section 3 opposite to the barrel section 2, and has a first annular end 41 opposite to the throat section 3. In this embodiment, the barrel section 2, the throat section 3 and the upper handle section 4 are integrally made of wood or aluminum alloy.

The lower handle section 5 is an independent piece and is made of fiber-reinforced plastic (FRP). The lower handle section 5 extends along the axis (X), and has a grip portion 53 and a knob portion 54. The grip portion 53 has a second annular end 51 that abuts against the first annular end 41 and that has a contour identical to that of the first annular end 41. The knob portion 54 has a bottom end portion 52 that is opposite to the second annular end 51, and a first cross-section (E) that is adjacent to the bottom end portion 52 and that is oblique to the axis (X). The grip portion 53 of the lower handle section 5 has a length along the axis (X) ranging from 4 inches to 7 inches, which corresponds to the width of an adult's hand.

The knob portion 54 further has an upper surrounding surface 541 that is disposed over the first cross-section (E) and that is connected to the grip portion 53, a bottom surf ace 542 that is disposed under the first cross-section (E), and a neck surrounding surface 543 that interconnects the upper surrounding surface 541 and the bottom surface 542. The bottom surface 542 is a convex surface, and the neck surrounding surface 543 has a concave surface portion.

The first cross-section (E) of the knob portion 54 of the lower handle section 5 is elliptic and has a major axis (A) (see FIG. 5) and a minor axis (B) (see FIG. 7) perpendicular to the major axis (A). The major axis (A) is oblique to the axis (X).

Figure 7:
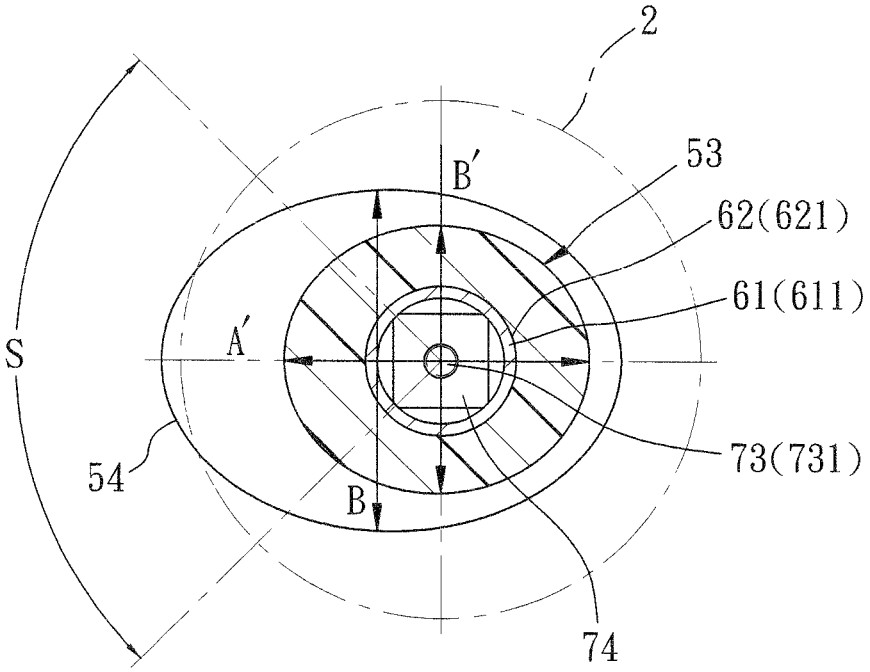
FIG. 7 is a sectional view of the preferred embodiment taken along line VII-VII in FIG. 5.

Referring to FIG. 7, the grip portion 53 of the lower handle section 5 has an elliptic second cross-section that is proximate to the knob portion 54 of the lower handle section 5, and that is perpendicular to the axis (X). The second cross-section has a major axis (A'), and a minor axis (B') that is perpendicular to the major axis (A') and that is parallel to the minor axis (B) of the first cross-section (E).

Referring back to FIG. 3, the connecting unit 6 includes a connecting rod 61 that extends from the first annular end 41 of the upper handle section 4 along the axis (X), and a retaining space 62 that is formed in the lower handle section 5, that extends inwardly from the second annular end 51 of the lower handle section 5 along the axis (X), and that is engaged fittingly and separably with the connecting rod 61.

The connecting rod 61 has a rod portion 611 and a positioning portion 612. The rod portion 611 is connected to the upper handle section 4 and has a circular cross-section. The positioning portion 612 is connected to the rod portion 611 opposite to the upper handle section 4.

Figure 6:
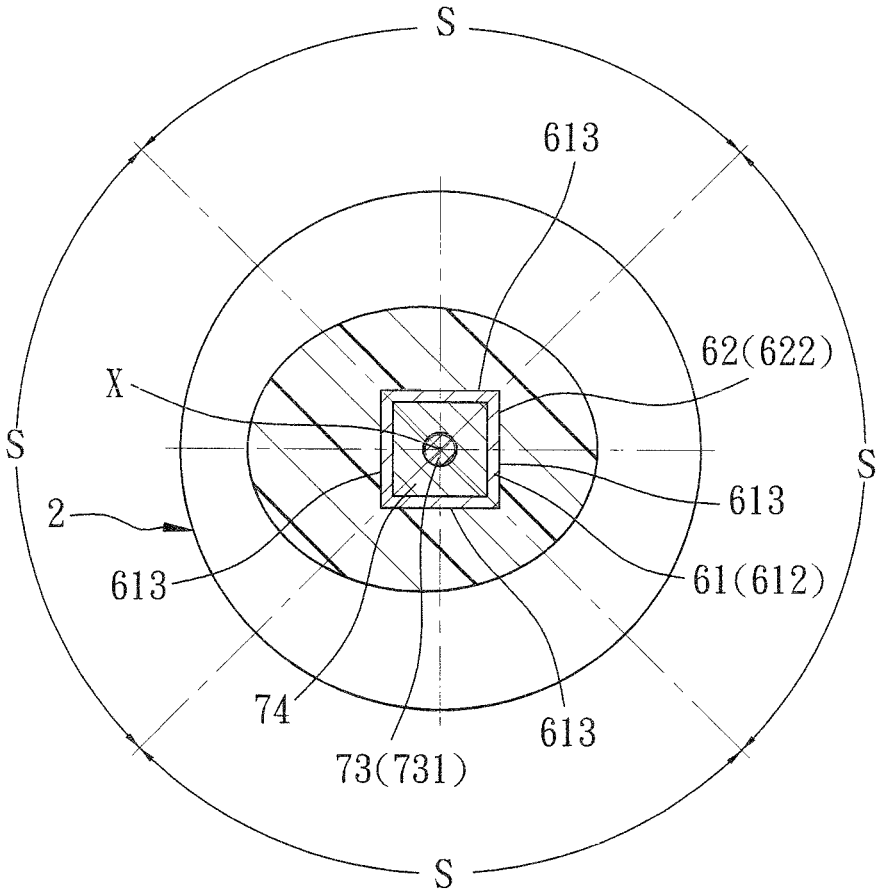
FIG. 6 is a sectional view of the preferred embodiment taken along line VI-VI in FIG. 5.

Referring to FIG. 6, the positioning portion 612 has a cross-section that is non-circular and that has a rotational symmetry with respect to the axis (X). Preferably, the cross-section of the positioning portion 612 has at least two straight edges. In this embodiment, the cross-section of the positioning portion 612 is square and has four straight edges 613.

The retaining space 62 of the connecting unit 6 has a straight space portion 621 for fittingly and separably retaining the straight rod portion 611 of the connecting rod 61, and a positioning space portion 622 engaged fittingly and separably with the positioning portion 612.

The securing unit 7 has a through hole 71 that is formed in the lower handle section 5, that is in spatial communication with the retaining space 62, and that extends along the axis (X), an abutment surface 72 that is disposed at an end of the through hole 71 opposite to the retaining space 62 and that is normal to the axis (X), a securing member 73 that is configured as a bolt, and a screw nut 74 that is disposed fixedly in the positioning portion 612 of the connecting rod 61.

The securing member 73 is disposed for securing the connecting rod 61 to the lower handle section 5, and has a rod portion 731 extending through the through hole 71 and engaging threadedly and separably the screw nut 74, and a head portion 732 connected to the rod portion 731 and abutting against the abutment surface 72.

As shown in FIGS. 3 and 4, the reinforcing tube 8 extends along the axis (X) and is disposed in the barrel section 2, the throat section 3 and the upper handle section 4. In this embodiment, the reinforcing tube 8 and the connecting rod 61 are formed integrally and are made of carbon fiber.

A user is likely to grasp the ball bat of this invention in a specific orientation since the lower handle section 5 is asymmetric, so that only a limited region of the ball bat is utilized as the ball-striking region. In accordance with the rotational symmetry of the positioning portion 612 and the positioning space portion 622 in this embodiment, an outer surrounding surface of the barrel section 2 can be divided equally into four ball-striking regions (S) (see FIG. 6). Once a ball-striking region (S) has been damaged after long-term use, one of the remaining ball-striking regions (S) can be utilized by the following procedures. First, the securing member 73 is unfastened from the screw nut 74, so that the positioning portion 612 can be separated from the positioning space portion 622. Afterward, the connecting rod 61 is rotated about 90 degrees and reinserted into the positioning space portion 622, and the securing member 73 is re-applied to engage threadedly the screw nut 74 in the connecting rod 61. As such, a new ball-striking region (S) can be utilized while the user maintains to grasp the lower handle section 5 in the specific orientation, and such operation can be performed two more times. Therefore, a service life of the asymmetric ball bat is lengthened.

To sum up, by virtue of the separable asymmetric lower handle section 5 and the positioning portion 612 with the non-circular and rotational-symmetric cross-section, the ball bat of this invention is easier to be grasped without increasing a width of the grip portion 53, and the service life of the ball bat is lenthened. Moreover, the integrally-formed reinforcing tube 8 and connecting rod 61 may improve the structural strength of the ball bat.

It is noted that the lower handle section 5 in this embodiment may be symmetric. The cross-sections of the positioning portion 612 and the positioning space portion 622 may be in other shapes to result in variation of the number of the ball-striking regions (S). Moreover, the rod portion 611 may be omitted (i.e., the entire connecting rod 61 may have a uniform cross-section that is non-circular and that has a rotational symmetry).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A ball bat comprising:

a barrel section extending along an axis;

a throat section extending taperingly from an end of said barrel section along the axis;

an upper handle section extending along the axis from an end of said throat section opposite to said barrel section, and having a first annular end opposite to said throat section;

a lower handle section extending along the axis, and having a second annular end that abuts against said first annular end and that has a contour identical to that of said first annular end, and a bottom end portion that is opposite to said second annular end;

a connecting unit including a connecting rod that extends from said first annular end of said upper handle section along the axis, and a retaining space that is formed in said lower handle section, that extends inwardly from said second annular end of said lower handle section along the axis, and that is engaged fittingly and separably with said connecting rod; and a securing unit having a through hole that is formed in said lower handle section, that is in spatial communication with said retaining space, and that extends along the axis, an abutment surface that is disposed at an end of said through hole opposite to said retaining space, and a securing member that has a rod portion extending through said through hole and secured to said connecting rod of said connecting unit, and a head portion connected to said rod portion and abutting against said abutment surface.

2. The ball bat as claimed in claim 1, wherein said connecting rod of said connecting unit has a positioning portion, said positioning portion having a cross-section that is non-circular and that has a rotational symmetry with respect to the axis, said retaining space having a positioning space portion engaged fittingly and separably with said positioning portion.

3. The ball bat as claimed in claim 2, wherein said cross-section of said positioning portion of said connecting rod has at least two straight edges.

4. The ball bat as claimed in claim 3, wherein said cross-section of said positioning portion of said connecting rod is square.

5. The ball bat as claimed in claim 2, further comprising a reinforcing tube extending along the axis and disposed in said barrel section, said throat section and said upper handle section, said reinforcing tube and said connecting rod being formed integrally and being made of carbon fiber, said securing unit further including a screw nut disposed in said positioning portion of said connecting rod, said securing member being configured as a bolt that engages threadedly and separably said screw nut.

6. The ball bat as claimed in claim 1, wherein said lower handle section further has a grip portion having said second annular end, and a knob portion having said bottom end portion.

7. The ball bat as claimed in claim 6, wherein said knob portion of said lower handle section further has a first cross-section that is adjacent to said bottom end portion and that is oblique to the axis, an upper surrounding surface that is disposed over said first cross-section and that is connected to said grip portion, a bottom surface that is disposed under said first cross-section, and a neck surrounding surface that interconnects said upper surrounding surface and said bottom surface.

8. The ball bat as claimed in claim 7, wherein said first cross-section of said knob portion of said lower handle section is elliptic and has a major axis and a minor axis perpendicular to said major axis, said major axis being oblique to said axis.

9. The ball bat as claimed in claim 8, wherein said grip portion of said lower handle section has an elliptic second cross-section proximate to said knob portion of said lower handle section, perpendicular to the axis, and having a major axis and a minor axis that is parallel to said minor axis of said first cross-section of said knob portion of said lower handle section.

10. The ball bat as claimed in claim 7, wherein said bottom surface is a convex surface, and said neck surrounding surface has a concave surface portion.

11. The ball bat as claimed in claim 6, wherein a length of said grip portion of said lower handle section along the axis ranges from 4 inches to 7 inches.

* * * * *